United States Patent [19]

Kramer et al.

[11] Patent Number: 4,792,353

[45] Date of Patent: Dec. 20, 1988

[54] ALUMINUM OXIDE-METAL COMPOSITIONS

[75] Inventors: Bruce M. Kramer, Washington, D.C.; David M. Dombrowski, Milford, Ohio; Dennis Gonseth, Chemin Des Rannaux, Switzerland; Minyang Yang, Hopedale, Mass.; Stephen P. Kohler, Derry, N.H.

[73] Assignee: Massachusetts Institute of Technology, Cambridge, Mass.

[21] Appl. No.: 917,577

[22] Filed: Oct. 10, 1986

[51] Int. Cl.[4] ..... C22C 29/12
[52] U.S. Cl. ..... 75/235
[58] Field of Search ..... 75/235

[56] References Cited

U.S. PATENT DOCUMENTS

| | | | |
|---|---|---|---|
| 3,723,077 | 3/1973 | Frehn | 75/235 |
| 4,655,830 | 4/1987 | Akashi et al. | 75/235 |

FOREIGN PATENT DOCUMENTS

| | | | |
|---|---|---|---|
| 3444712 | 6/1986 | Fed. Rep. of Germany | 75/235 |
| 51-41606 | 4/1976 | Japan | 75/235 |
| 647813 | 2/1985 | Switzerland | 75/235 |
| 317716 | 6/1972 | U.S.S.R. | 75/235 |
| 821596 | 10/1959 | United Kingdom | 75/235 |
| 841576 | 7/1960 | United Kingdom | 75/235 |

*Primary Examiner*—John F. Terapane
*Assistant Examiner*—Eric Jorgensen
*Attorney, Agent, or Firm*—Paul J. Cook

[57] ABSTRACT

A consolidated metal-ceramic composite comprises a first phase of particles of aluminum oxide or a solid solution based on aluminum oxide uniformly distributed in a second matrix phase wherein the second matrix phase is non-reactive with aluminum oxide and contains a sufficient amount of titanium carbide at the interface between the first and second phase to prevent a chemical reaction at the interface during consolidation at the liquidus temperature and which exhibits good mechanical properties with regard to strength and toughness at high temperatures up to about 1200° C.

5 Claims, No Drawings

ALUMINUM OXIDE-METAL COMPOSITIONS

FIELD OF THE INVENTION

The present invention relates to aluminum oxide-metal compositions and a process for their production.

BACKGROUND OF THE INVENTION

Aluminum oxide has the characteristic of excellent wear resistance. The material is used for cutting tools for metals and for wear resistant surfaces. Aluminum oxide in the form of coatings on conventional carbide tools is formed by vapor deposition or sputtering. It is known that the mechanical properties of aluminum oxide can be improved by forming solid solutions with other oxides such as chromium oxide or by forming multiphase compositions with other oxides such as zirconium. Furthermore, it is known to form aluminum oxide cutting tools by sintering or a hot pressing process. Aluminum oxide compositions may also include grain boundary pinning additives such as magnesium oxide, titanium oxide or titanium carbide. Aluminum oxide tools are too brittle for most steel cutting operations and their use is limited to finishing cuts because their lack of ductility results in their inability to withstand even medium loads or vibration between the tool and workpiece without fracture. Attempts have been made to fabricate aluminum oxide based cermets for cutting tools with little success. This is due to the inability to bond aluminum oxide to metals. Therefore, prior art attempts to significantly increase the fracture toughness of the resulting composite have not been successful.

Hot pressed aluminum oxide-titanium carbide and aluminum oxide-silicon carbide whisker mixtures are the strongest available oxide-based ceramics.

It has been proposed in U.S. Pat. No. 4,217,113 to form aluminum oxide-containing metal compositions for use as cutting tools under conditions to form a reactive metal oxide phase at the interface of the aluminum oxide which is formed from a metal derived from the metallic phase and the aluminum oxide. However, since few oxides exceed aluminum oxide in toughness and strength at high temperatures, failure in these compositions has been found to occur at the metal oxide formed at the interface between the aluminum oxide and the metal. Heretofore, the prior art has concentrated on forming a reactive metal oxide interface between the metal matrix and aluminum oxide to improve the fracture toughness of aluminum oxide compositions.

SUMMARY OF THE INVENTION

According to the present invention, interfacial oxide phases are substantially completely eliminated with a resulting improvement in fracture toughness. In accordance with the present invention, there is provided a consolidated metal-ceramic composite comprising a first phase consisting essentially of particles of aluminum oxide uniformly distributed in a second matrix phase. The second matrix phase consisting essentially of a first metal , titanium carbide, and less than aobut 20% by weight additional ingredients. The second matrix phase is rendered non-reactive with aluminum oxide by the inclusion of a sufficient amount of titanium carbide at the interface between the aluminum oxide and second matrix phase to prevent a chemical reaction at the interface between the matrix and the aluminum oxide particles during consolidation at the liquidus temperature.

The structure obtained from the present invention is characterized by the absence of brittle or low strength interfacial phases or the absence of an interface of reacted compounds such as oxides.

When used as a cutting tool, the composition of this invention contains less than about 30 volume percent of the metal matrix phase component. The composition is also useful for making structural parts exhibiting good resistance to abrasion and chemical wear, including oxidation which contain a metal phase in concentrations up to about 40 volume percent. The compositions of this invention are prepared by hot pressing or sintering or hot isostatic pressing, alone or in combination, the aluminum oxide containing particles, the predominant metallic constituent of the binder, the titanium carbide and additional alloying elements in a non-oxidizing atmosphere such as a vacuum or under a non-reactive gas and preferably under a controlled partial pressure of carbon monoxide.

According to a preferred process, all or part of the titanium carbide that is present at the interface may be provided by coating the aluminum oxide component in the form of particles with titanium carbide prior to consolidating the particles to form an article.

DETAILED DESCRIPTION OF THE EMBODIMENT

The compositions of this invention are prepared by consolidating a microscopically homogeneous powder mixture of (a) aluminum oxide and/or a solid solution containing one or more components of aluminum oxide and (b) a matrix phase. The matrix phase comprises a metal component capable of retaining relatively high concentrations of titanium and carbon and a source of titanium and carbon. The relative concentrations of titanium and carbon are sufficient to form titanium carbide to a sufficient extent to prevent a reaction at the interface between the matrix phase and the aluminum oxide phase. Such a reaction is avoided since it can result in the formation of interphase compositions which can be deleterious. Suitable temperatures for consolidating the homogeneous mixture to form an article are from the minimum temperature at which the matal component forms a liquid with the appropriate concentration of titanium and carbon to the melting point of aluminum oxide. Preferably, the temperature is from about 1300° to about 1600° C. The mixture is subjected to elevated temperature for a sufficient period for the titanium and carbon components to be dissolved in the metal matrix component such that titanium and carbon are retained in the metal matrix in liquid solution. It is believed that the presence of titanium carbide at the interface retards or prevents a reaction at the interface of the metal matrix and the aluminum oxide.

When forming cutting tools or other wear resistant surfaces, the compositions prepared by the process of this invention contain between about 70 and about 90 volume percent of the aluminum oxide. When forming abrasion resistant apparatus such as valves, fuel pump components for slurries, structural parts for engines or the like, the compositions of the present invention contain more than about 50 volume weight percent of the aluminum oxide.

The possible reactions of $Al_2O_3$ and TiC are shown by the following equations:

$$2Al_2O_3+3TiC=Al_4C_3+3TiO_2 \quad (1)$$

and $$Al_2O_3+3TiC=5(Al_{0.4}Ti_{0.6})+3CO\uparrow \quad (2)$$

$$\text{and } \frac{x}{2}\,Al_2O_3+(a+y)\,TiC=Al_xTi_y+Ti_aO_b+(a+y)CO\uparrow \quad (3)$$

where $b=[1.5x-(a+y)]$.

In order to insure that reaction (2) proceeds in preference to the others and to suppress the formation of detrimental titanium oxide, it is important that the CO partial pressure during sintering be maintained in a range of from about $10^{-5}$ to $10^{-2}$ torr and preferably about $10^{-4}$ to $10^{-3}$ torr.

The composition of this invention are characterized by a microstructure which is substantially composed of an aluminum oxide ceramic phase separated and cemented by a ductile metallic matrix phase. The interface between the aluminum oxide phase and the metallic matrix phase is mainly composed of titanium carbide. The compositions of this invention have exhibited a fracture toughness of 8 to 15 $MN/m^3/2$ as compared to 4 to 5 $MN/m^3/2$ for commercially available alumina-based compositions. In order to mix the components forming the compositions of this invention, they are mixed and comminuted by processes such as by ball milling, air milling or the like, prior to subjecting the mixture to elevated temperature and pressure.

Representative sources of titanium are titanium and titanium carbide. Representative sources of carbon are titanium carbide, carbon, molybdenum carbide, tungsten carbide, vanadium carbide, chromium carbide, tantalum carbide, niobium carbide, zirconium carbide or hafnium carbide. Representative suitable first metal components which are relatively non-reactive with aluminum oxide, titanium and titanium carbide include nickel, iron, cobalt or combinations thereof. Solubility of the titanium and carbon in the metal matrix phase can be improved by adding a third component in an amount generally of between about 5 and 30 weight percent based upon the weight of the first metal component, such as molybdenum carbide, tungsten carbide, vanadium carbide, ruthenium, rhodium, rhenium and osmium.

Any available form of aluminum oxide can be utilized in the present invention, including powder of a particle size between about 0.1 amd 100 micrometers in diameter, whiskers, fibers or other solid shapes. The present invention may also be employed to join solid aluminum oxide components to each other or to metallic components.

According to a preferred embodiment, the aluminum oxide particles are precoated with titanium carbide, titanium oxycarbides or titanium prior to being admixed with the metallic matrix component. Suitable coating techniques include chemical vapor deposition, plasma-assisted chemical vapor deposition, laser-assisted chemical vapor deposition, sputtering, physical vapor deposition, vacuum evaporation or reduction of titanium oxide coating on the surface of aluminum oxide particles.

The above coating process may be carried out in a reaction chamber which is surrounded by an induction coil electrically connected to a radio frequency oscillator. The inlet and outlet are at representative axial ends for the flow of the gaseous medium. The untreated powder is placed in the reaction chamber and subjected to the desirable coating temperatures by actuation of the radio frequency oscillator.

As an example, titanium carbide layers are formed on the aluminum oxide particles in the reaction chamber by entraining the particles in a gaseous mixture of titanium tetrachloride, a gaseous carbon source such as methane and hydrogen and heating the particles to a temperature of between about 800° C. and about 1800° C., preferably at temperatures above about 1000° C. The reaction is described by the following equation, although hydrogen is often added to insure that the reaction takes place in a reducing environment:

$$TiCl_4+CH_4\rightarrow TiC+4\,HCl\uparrow$$

The mixture containing the particles is maintained at the reaction temperature until the desired coating thickness is achieved. Routine experimentation is used to determine the rate of coating thickness growth at a particular gaseous flow rate and temperature. Typically preferred coatings are on the order of 100–1000 Angstroms and preferably from 200–500 Å.

EXAMPLE I

The following example illustrates the present invention and is not intended to limit the same.

Alumina powders were placed in a glass chromatography pyrex glass tube with a tapered end in which a porous glass frit was mounted. Argon was introduced into the tube and passed through the glass frit and powder bed. By precisely controlling the flow of gas, with a micrometer valve, only the fine particles were entrained in the gas stream and introduced into the reactor chamber either at the bottom of the chamber in the gas inlet or directly into the plasma by joining an extended alumina tube with the normal gas/powder inlet. Powder was collected by reducing the velocity of the gas stream in an expanded chamber and filtering the gas through stainless steel filters. After the generator was operating at full power, argon was introduced into the reactor chamber until a flow of 750 ml/min was achieved. At this time, the gas micture of $TiCl_4+CH_4+H_2$ was introduced. After a plasma composed of the reactant was operating at the desired flow parameters, argon gas was slowly introduced through the powder bed. Gas flow was increased until fine powders could be seen to leave the fluidizing chamber and enter the plasma chamber.

After a sufficient quantity of coated powder was obtained, nine specimens were prepared and an additional three commercial ceramic composites were obtained for the purpose of comparison. The chemical composition of the various specimens prepared for this experiment are given in Table I.

The powders were ball milled for 24 hours in containers using 0.5 inch alumina balls as the grinding media. The powder mixtures were then placed in a die and uniaxially pressed into compacts with about 100 Kpsi. These compacts were sintered in vacuum for 1 hour at 1370° C. These alumina-based sintered specimens were encapsulated in steel containers and hot isostatically pressed at 45 Kpsi and 1370° C. for the compacts #4 and 7 and 35 Kpsi and 1315° C. for the compacts #5, 6, 8 and 9. These HIP'ed specimens were cut using diamond blades, mounted and polished in order to examine their microstructures.

TABLE I

| Chemical Composition of Compact Specimens | |
|---|---|
| Specimen # | Composition (vol. %) |
| 1 | 62.5TiC—34.1Ni—3.4$Mo_2C$ |
| 2 | 76.9TiC—21.0Ni—2.1$Mo_2C$ |
| 3 | 83.3TiC—15.2Ni—1.5$Mo_2C$ |
| 4 | 65.8$Al_2O_3$—29.0Ni—5.TiC |
| 5 | 79.4$Al_2O_3$—17.5Ni—3.1TiC |
| 6 | 85.2$Al_2O_3$—12.5Ni—2.3TiC |
| 7 | 65.8TiC—Coated $Al_2O_3$—32.1Ni—3.1$Mo_2C$ |
| 8 | 79.4TiC—Coated $Al_2O_3$—18.7Ni—1.9$Mo_2C$ |
| 9 | 85.3TiC—Coated $Al_2O_3$—13.4Ni—1.3$Mo_2C$ |
| 10 | 99.9% Pure $Al_2O_3$, Sintered |
| 11 | 70 wt % $Al_2O_3$—30 wt % TiC, Hot pressed |
| 12 | 80 wt % $Al_2O_3$—20 wt % SiC, Hot pressed |

In compositions 1, 2, and 3, carbide particles are seen to be dispersed within continuous binder phases, indicating that complete wettability of the solid phase leads to intergranular penetration by the liquid metal. With decreasing metal content, the thickness of binder phase decreases and more carbide particles appear to be in contact with neighboring carbide particles. In compositions 4, 5 and 6, the alumina phase is aggregated and continuous and the metal phase is distributed in isolated pockets by the alumina phase, indicating that incomplete wetting results in apparent solid-state sintering of alumina powders.

In the TiC-coated alumina-based alloys, compositions 7,8 and 9 at high metal content, the alumina phase is surrounded by the metal phase which appears to be continuous. The size distribution of alumina particles appear to be contiguous, but the TiC-coated alumina particles are more uniformly dispersed in the metal binder than the uncoated ones.

The results of the hardness $H_v$ and the indentation crack resistance W are given in Table II with the calculated elastic moduli E, the stress intensity factor $K_{IC}$ and the strain energy release rate $G_{IC}$. The $K_{IC}$ and $G_{IC}$ values were determined through the use of the Palmquist indentation technique.

TABLE II

| | | | Properties of Specimens | | | | |
|---|---|---|---|---|---|---|---|
| | Specimen | Binder Vol. % | Hardness $H_v$ [$Kg/mm^2$] | Indentation Crack Resistance W [$MJ/m^2$] | Elastic Modulus E [$GN/m^2$] | Fracture Toughness $K_{IC}$ [$MN/m^{3/2}$] | Strain Energy Release Rate $G_{IC}$ [$J/m^2$] |
| TiC-based | 1 | 34.1 | 1003 | 5.24 | 300 | 13.2 | 581 |
| | 2 | 21.0 | 1285 | 1.48 | 326 | 11.5 | 406 |
| | 3 | 15.2 | 1604 | 0.84 | 338 | 9.8 | 284 |
| Uncoated | 4 | 29.0 | 1497 | 0.79 | 339 | 9.0 | 239 |
| $Al_2O_3$ | 5 | 17.5 | 1693 | 0.56 | 359 | 7.9 | 174 |
| | 6 | 12.5 | 1811 | 0.44 | 367 | 5.6 | 85 |
| TiC-Coated | 7 | 32.1 | 908 | 6.82 | 308 | 12.4 | 499 |
| Powder | 8 | 18.7 | 1159 | 1.15 | 337 | 10.8 | 346 |
| | 9 | 13.4 | 1400 | 0.80 | 351 | 8.9 | 226 |
| Pure $Al_2O_3$ | 10 | — | 1724 | 0.36 | 390 | 4.2 | 45 |
| $Al_2O_3$ + TiC | 11 | — | 1869 | 0.37 | 387 | 4.5 | 52 |
| $Al_2O_3$ + SiC Whiskers | 12 | — | 2452 | 0.39 | 403 | 4.6 | 53 |

We claim:

1. A consolidated metal-ceramic composite comprising a first phase consisting essentially of particles more than 50 volume percent aluminum oxide of a size less than 0.1 mm uniformly distributed in a second matrix phase, said second matrix phase consisting essentially of (a) a first metal, selected from the group consisting of nickel, cobalt and mixtures thereof, (b) titanium carbide coating said aluminum oxide and (c) less than about 30 percent by weight of a third component that renders titanium carbide more soluble in said first metal, said second matrix phase being non-reactive with aluminum oxide and containing titanium carbide primarily concentrated at an interface between the first and second phase in a sufficient amount to prevent a chemical reaction at said interface during consolidation at the liquidus temperature of said second matrix phase.

2. A consolidated metal-ceramic composite according to claim 1 wherein said aluminum oxide comprises a solid solution comprising at least one element in aluminum oxide.

3. A consolidated metal-ceramic composite according to any of claims 1, or 2 wherein the third component is selected from the group consisting of molybdenum carbide, chromium carbide, tungsten carbide, vanadium carbide, tantalum carbide niobium carbide, ruthenium, rhodium, rhenium osmium and mixtures thereof.

4. A consolidated metal-ceramic composite according to any of claims 1, or 2 wherein the third component is selected from the group consisting of molybdenum, molybdenum carbide or a combination of molybdenum and molybdenum carbide.

5. The consolidated metal-ceramic component according to claim 1 wherein the aluminum oxide particles comprise aluminum oxide whiskers.

* * * * *